United States Patent [19]

Beauchamp et al.

[11] Patent Number: 4,995,116

[45] Date of Patent: Feb. 26, 1991

[54] ARMS FREE PRIVACY CAPE FOR BREAST FEEDING INFANTS

[76] Inventors: Matthew R. Beauchamp; Maryellen S. Beauchamp, both of 2056 Lincoln Rd., Yuba City, Calif. 95991

[21] Appl. No.: 432,376

[22] Filed: Nov. 6, 1989

[51] Int. Cl.[5] ..... A41D 1/26; A41D 1/22

[52] U.S. Cl. ..... 2/104; 2/88

[58] Field of Search ..... 2/104, 114, 88, 102; 450/31, 32, 36

[56] References Cited

U.S. PATENT DOCUMENTS

| | | | |
|---|---|---|---|
| 778,014 | 12/1904 | Coyle | 2/114 |
| 1,206,480 | 11/1916 | Stagg | 2/104 |
| 1,467,718 | 9/1923 | Entrikin et al. | 2/88 |
| 2,029,564 | 2/1936 | Gowdy | 2/88 |
| 2,417,888 | 3/1947 | Schuster . | |
| 2,911,650 | 11/1959 | Gerich | 2/104 X |
| 3,154,789 | 11/1964 | Lewis, Jr. . | |
| 3,203,424 | 8/1965 | Garutso | 450/36 X |
| 3,449,763 | 6/1969 | Grate | 450/36 X |
| 3,459,191 | 8/1969 | Barg | 450/36 |
| 3,611,439 | 10/1971 | Meyers . | |
| 4,031,566 | 6/1977 | Johnson | 2/104 |
| 4,106,122 | 8/1978 | Dodd | 2/104 |
| 4,144,593 | 3/1979 | Timmons . | |
| 4,458,365 | 7/1984 | Wood | 2/104 |
| 4,528,699 | 7/1985 | Hughes . | |
| 4,566,136 | 1/1986 | Echols . | |
| 4,567,611 | 2/1986 | Kendrick | 2/104 |
| 4,571,743 | 2/1986 | Wagoner | 2/114 X |
| 4,601,068 | 7/1986 | Frechette | 2/104 |
| 4,651,349 | 3/1987 | Heiler | 2/104 |
| 4,660,227 | 4/1987 | Abramson . | |
| 4,663,782 | 5/1987 | Knox et al. | 2/104 |
| 4,712,251 | 12/1987 | Cobble | 2/104 X |
| 4,797,953 | 1/1989 | Dameron | 2/102 X |
| 4,924,528 | 5/1990 | Trombetti-Dickens | 2/104 |

*Primary Examiner*—Werner H. Schroeder
*Assistant Examiner*—Jeanette E. Chapman

[57] ABSTRACT

A privacy covering for breast feeding an infant in public places is provided in a simple, light weight nursing cape. The nursing cape is designed to be easily draped over and cover the shoulders of a nursing mother with her neck passed through a central neck opening and her head above the cape shoulders. The cape is structured with a one-piece back and an opening in the front producing two front panels. The front opening has releasable fasteners and the opening can be closed with the nursing cape over and protecting the mother's clothing as well as providing privacy for the nursing mother. The length of the front panels provides a covering for the feeding infant. One embodiment of the invention has two transverse openings, one on each side in the front panels, providing the mother with surveillance openings to look down at the infant without exposing herself to public view. The surveillance openings also provide additional ventilation for the nursing infant.

4 Claims, 4 Drawing Sheets

ARMS FREE PRIVACY CAPE FOR BREAST FEEDING INFANTS

BACKGROUND OF THE INVENTION

1. Field of the invention

This invention relates to garments designed to provide privacy to a nursing mother while in public areas, such as restaurants and the like. The present invention is particularly directed towards a single-piece, arms free garment with viewing openings available to the nursing mother which do not expose the feeding child or the mother's breast to public view.

2. Description of the Prior Art

To ascertain the status of developing art in this field a study was made of past art patents found in the classes and subclasses 2/101, 104, 88, 174, and 49R. Patents found in the search which appeared most pertinent to our invention included the following U.S. Patents:

A patent issued to Schuster on Mar. 25, 1947, U.S. Pat. No. 2,417,888, shows a vest to be worn over a nursing mothers garments. Openings in the vest make the mother's breast available to the infant and protect the mother's clothing from slobbers and from ill smelling fluids which might be discharged during burping. This is primarily an external clothing protective garment and is not arranged to provide a covering for the child or privacy for the mother.

In U.S. Pat. No. 3,154,789, issued Nov. 3, 1964, to E. Lewis, Jr., a disposable examination garment is shown. This garment is worn as an undergarment and has individual flaps which can be raised to expose the female breast, primarily for a medical type examination. Although the Lewis covering has openable sections, it would be totally useless as a privacy covering for a feeding infant.

U.S. Pat. No. 4,144,593, issued to Timmons on Mar. 20, 1979, shows complete garments useful for feeding an infant by a fully clothed mother. Also shown is a night garment. The front of the clothing is opened and a partial covering is provided for the mother's breast which is not actually sufficient as a covering for a feeding child. These are rather complicated garments and do not provide the privacy for both the mother and the feeding child in public places which our simple cape covering does provide.

Hughes was granted U.S. Pat. No. 4,528,699 on July 16, 1985, for a two-piece garment having a breast covering section similar to an Empire waist retained by an elastic band in a gathered seam and an openable shoulder strap supported section which can be used as a covering for the mother's breast with the infant exposed. Our cape shields both the mother's breast and the feeding infant.

The Frechette patent, U.S. Pat. No. 4,601,068, issued July 22, 1986, is a sleeved nursing garment with the sides of the frontal section openable for feeding.

Other patents seen which show types of nursing garments with breast coverings include U.S. Pat. No. 3,611,439, dated Oct. 12, 1971, allowed Meyers; U.S. Pat. No. 4,601,068, granted to Echols on Jan. 28, 1986; and U.S. Pat. No. 4,660,227, dated Apr. 28, 1977, issued to Abramson. These patents show draping and vest like garments which are not simple and easy to use in public places and are worn like clothing rather than being cape-like covering for both mother and child which is what our design does provide.

SUMMARY OF THE INVENTION

To overcome deficiencies seen in past art offerings, we have provided a simple nursing cape with privacy covering for the mother and shielding features for the infant useful during breast feeding in public places. Our nursing cape is basically an oval shaped structure having a central neck opening and a frontal separation extending from the neck opening to the bottom edge of the garment. The frontal separation divides the front of the cape into two panels while the back of the cap is a single panel. The shoulders of the cape extend outward beyond the shoulder blades of the wearer and the bottom edge of the cape extends downward a short distance below the waist. In use, the mother places the cape over her shoulders over existing clothing and connects the front seam. The baby is then positioned for nursing underneath the cape. Made of soft material, the loose fit of the cape allows the mother free use of her hands beneath the garment to handle the nursing infant where it is shielded from view. Short surveillance openings through which the mother can monitor the feeding infant are arranged transversely, one over each breast. The surveillance openings have hook and loop type fastener edging which allows the openings to be fastened in a closed position when not in use. The surveillance openings are arranged so that mother can unfasten and spread them so they will remain opened. She can look down and see the head of the feeding child from above without exposing herself to view from persons seated or standing in a similar plane with herself. Lightweight and loose fit, our nursing cape also allows ample air circulation for the infant. The resealable seams are affixed with pads of hook and loop fasteners which allow easy connection and disconnection with one hand.

Our nursing cape is especially useful in public areas where some people may take offense at a mother breast feeding her infant. The garment is also lightweight and can be folded for easy storage in a purse or diaper bag. While wearing the nursing cape according to the invention, a nursing mother has her arms free and use of at least one hand for eating, writing, or for other purposes with the feeding infant shielded from view held in the mother's other arm under the nursing cape.

Therefore, a primary object of our invention is to provide a privacy cape which shields both the mother and the infant during breast feedings in public places.

Another object of the invention is to provide a light weight portable covering useful for privacy while breast feeding in infant in public places which is foldable and easily carried in a purse or diaper bag until needed.

A further object of our invention is to provide a nursing mother with a simple covering for breast feeding an infant in public which is easy to put on over the clothing being worn and leaves the mother's arms free for holding the infant.

A still further object of this invention is to provide a privacy cape for public breast feedings of infants which has transverse surveillance openings through which the mother can look down at a feeding infant without exposing herself or the feeding infant to public view.

Additional objects and the many advantages of the present invention will become understood by reading descriptions of the numbered parts in the specification and comparison of the described parts with like numbered parts illustrated in the included drawings.

DESCRIPTION OF THE PREFERRED EMBODIMENT

Figure 1:
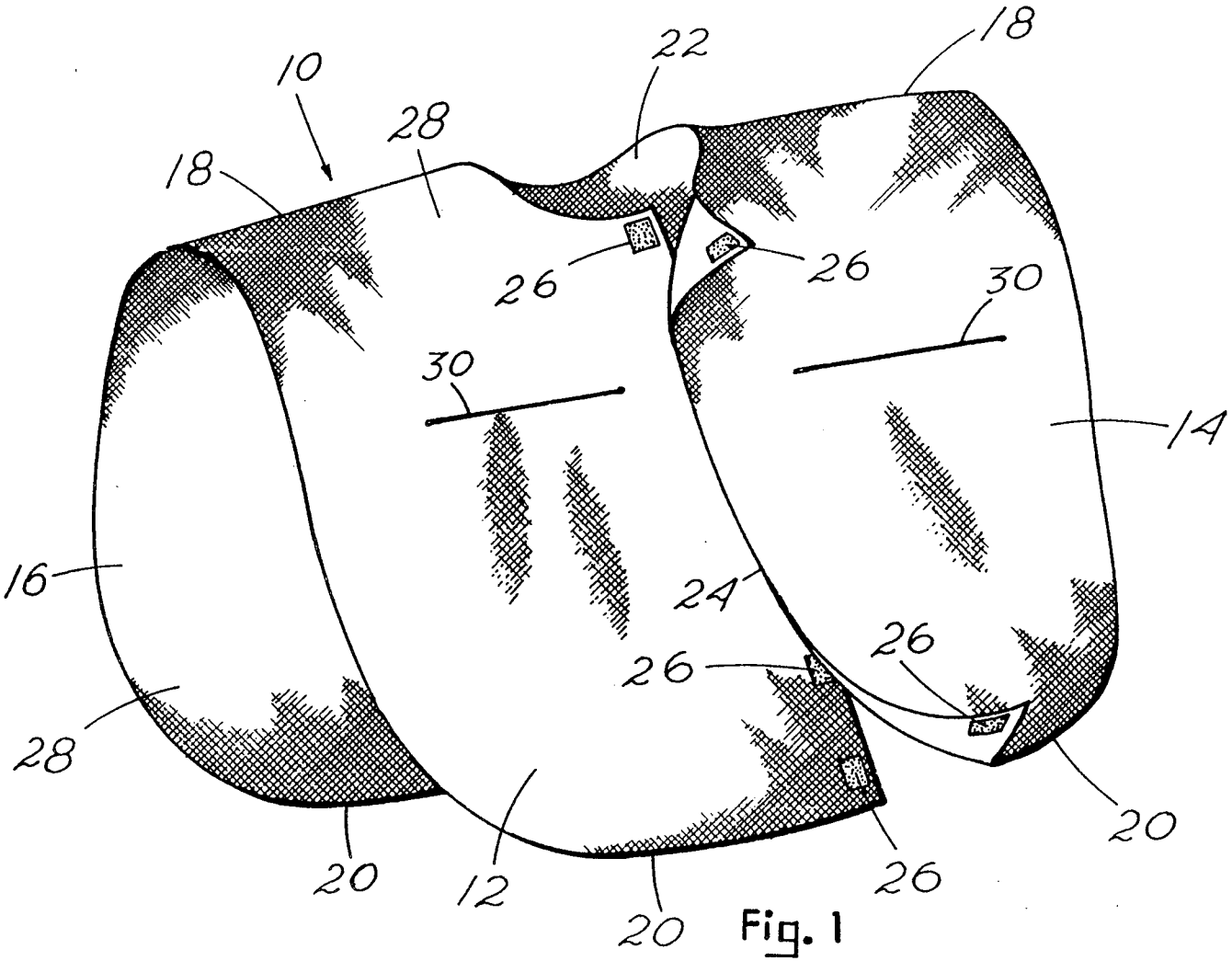
FIG. 1 is a perspective frontal view of the nursing cape according to the invention illustrating the frontal separation partially opened disclosing hook and loop type pad fasteners used as a simple releasable attachment method for opening and closing the cape. Two short transverse surveillance openings are shown, one in each front panel of the cape.
Figure 2:
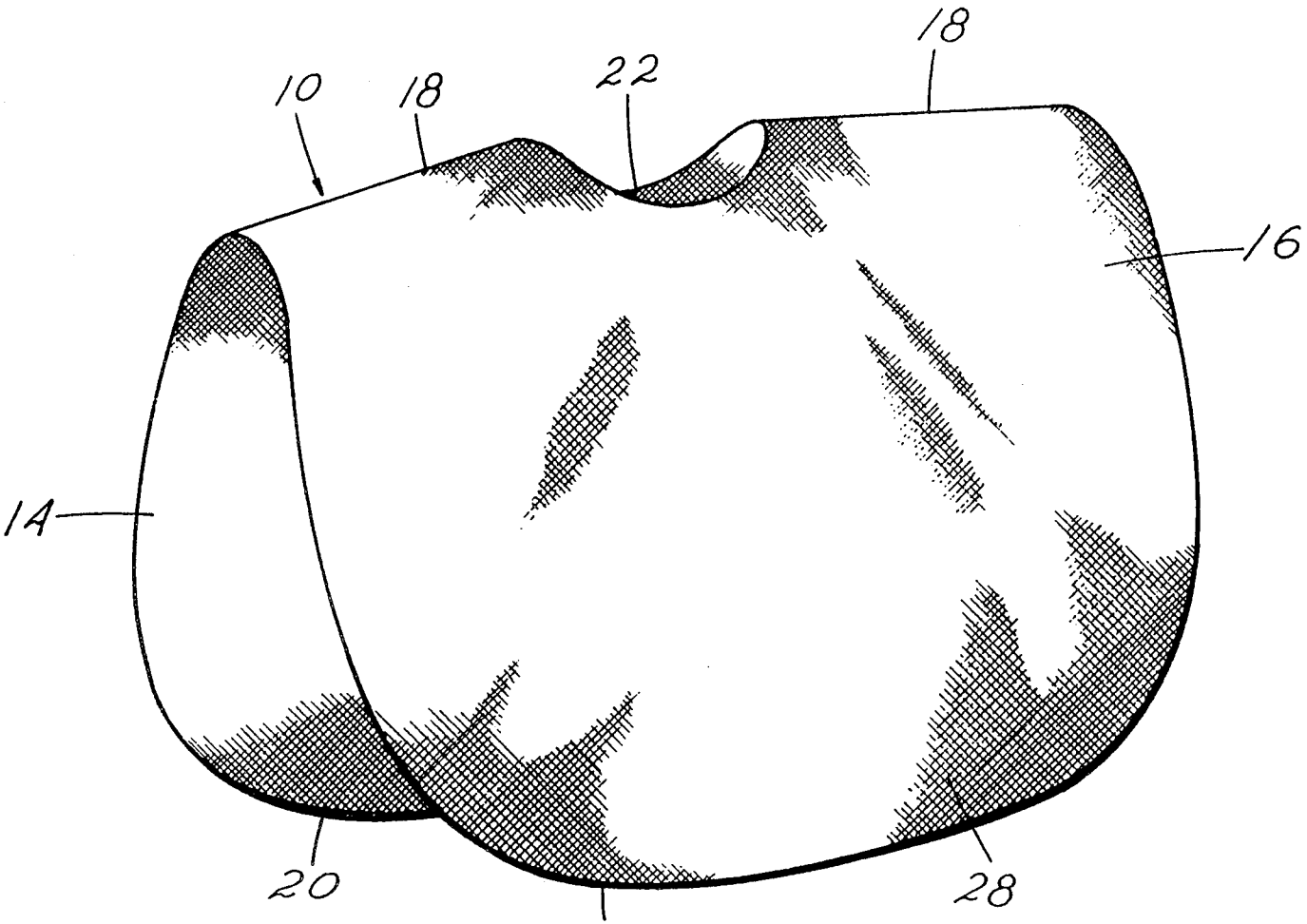
FIG. 2 is a perspective view showing the cape from the back illustrating the fabric structure and the neck opening and shoulder sections relative to the opened sides and bottom edges of the cape.
Figure 3:
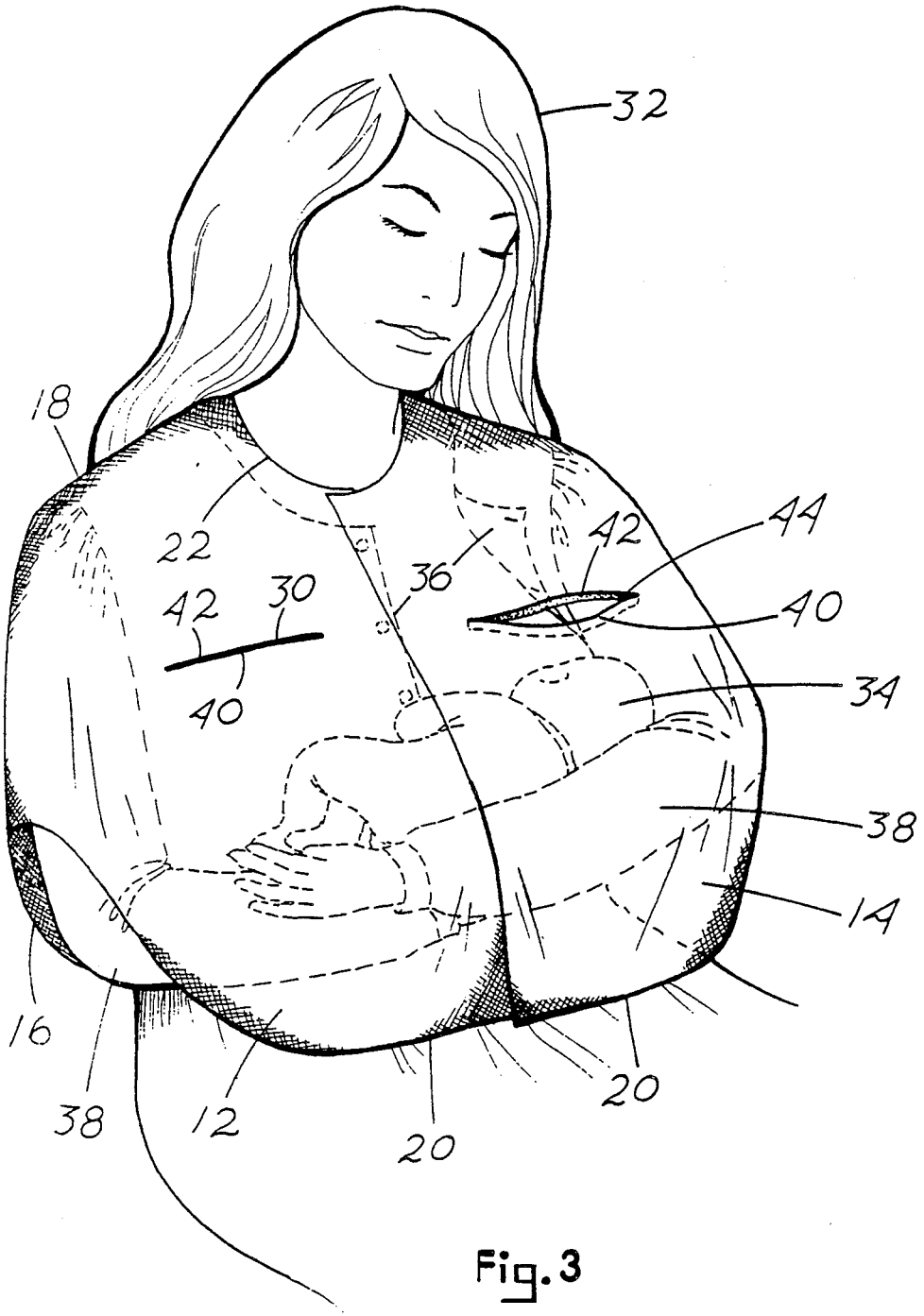
FIG. 3 is a perspective view of a mother wearing the nursing cape and nursing an infant held in her arms underneath the cape. One surveillance opening is shown opened so the mother can see the infant by looking down through the surveillance opening.

Referring now to the drawings where the nursing cape according to the invention is detailed in illustrations using nursing cape 10 generally indicative of the invention. In FIG. 1 nursing cape 10, shown in a frontal perspective view, is fabricated from light weight material 28 and is structured to be opened along a frontal separation 24 which divides the front into right panel 12 and left panel 14. Frontal separation 24 opens into central neck opening 22 upwards and ends downward at bottom edges 20. Central neck opening 22 as shown in drawing FIG. 1 and 2 is an open area in fabric material 28 to allow placement of the users neck therethrough during use. Central neck opening 22 is located between the two shoulder sections 18, and adjacent the tops of right and left panels 12 and 14. The top edge of back panel 16 defines the rearward side of opening 22. Shoulder sections 18 are merely the fold-over top of nursing cape 10 being designated shoulder sections 18 to describe a particular fit further in the specification. A full one-piece back panel 16 continues on downward from shoulder sections 18 ending downward at bottom edges 20 being comparable in length to both front panels 12 and 14. Although any fasteners such as buttons or ties are useful, frontal separation 24 is shown in the illustrations being held together by hook and loop fasteners 26 which makes frontal separation 24 easy to open and easy to secure. Unique to nursing cape 10 are surveillance openings 30 which are two short transverse pocket-like openings cut through the front panels of nursing cape 10. Surveillance openings 30 each have hook and loop pile stripping 42 affixed by double seaming 48 around the edges of the openings 30. One surveillance opening 30 is positioned in right front panel 12, and one surveillance opening 30 is positioned in left front panel 14 so that when nursing cape 10 is worn, one opening 30 is positioned just above each human breast. The positions of openings 30 allow a breast feeding mother 32 to open one opening 30 or the other to visually check on her feeding infant 34. Hook and loop stripping 42 provides sufficient stiffening to the edges of surveillance openings 30 to allow them to be pulled open and remain in an open position 44 to allow mother 32 to view her feeding infant 34 as shown in FIG. 3. The interfacing strips of hook and loop stripping 42 is used as the fastener to maintain openings 30 in a closed position.

In FIG. 2, the back side, single-piece back panel 16 of nursing cape 10 is shown in a perspective illustration. The back downward curve of central neck opening 22 can be seen upward in the illustration and the slight downward slope of shoulder sections 18 is shown. Back panel 16 and both front panels 12 and 14 terminate in paralleling positions at bottom edges 20 as can be seen partly of left front panel 14 in FIG. 2 and with a full view of both right front panel 12 and left panel 14 in FIG. 1. The length of shoulder sections 18 and the positioning of bottom edges 20 are important in producing the intended function of nursing cape 10.

Referring next to FIG. 3 where mother 32 is shown nursing feeding infant 34 while wearing nursing cape 10. As is illustrated in FIG. 3, nursing cape 10 provides privacy for mother 32 as well as a covering for feeding infant 34. Nursing cape 10 is structured of a soft pliable material, light weight fabric 28, and is easily folded into a small package for carrying in a purse or a diaper bag. The length of shoulder sections 18 provides adequate covering for the shoulders of mother 32 and frontal separation 24 held together by contact of hook and loop fasteners 26 making putting on and taking off of nursing cape 10 over mother's clothing 36 easily accomplished even one handed. As illustrated in FIG. 3, even through mother 32 has her clothing, mother's clothing 36, opened and is breast feeding infant 34, both she and the baby are protected form public scrutiny. It is to be noted form the illustration at FIG. 3 that both of mother's ares 38 are free to hold the baby under nursing cape 10 which, being manufactured of light weight fabric 28, drapes nicely over feeding infant 3 and other's arms 38. Unique to the present invention are short transverse surveillance openings 30 provided in the upper front section of both right front panel 12 and left front panel 14. Although nursing cape 10 is to be provided in an embodiment without surveillance openings 30, see FIG. 4, as a fully functional breast feeding privacy covering, surveillance openings 30 offer additional mental comfort for mother 32 in providing both a ventilation and a viewing factor. Surveillance openings 30, being transverse openings relative to panels 12 and 14 can only be looked down through, when opened, by mother 32 and she is spared the stares of seated or even standing persons when breast feeding infant 34 in a public area. It is to be noted that surveillance openings 30 do not expose the breasts of mother 32. Surveillance openings 30 are maintainable in a closed position by the contacting other of hook and loop stripping 42 along the opening edges. Through the use of the interfacing hook and loop stripping 42, and the stiffness provided by stripping 42, the edges of surveillance openings 30 will remain in an opened position 44 as illustrated in FIG. 3 until pushed closed and fastened by again contacting of the opposing hook or loop portion of hook and loop stripping 42.

Figure 4:
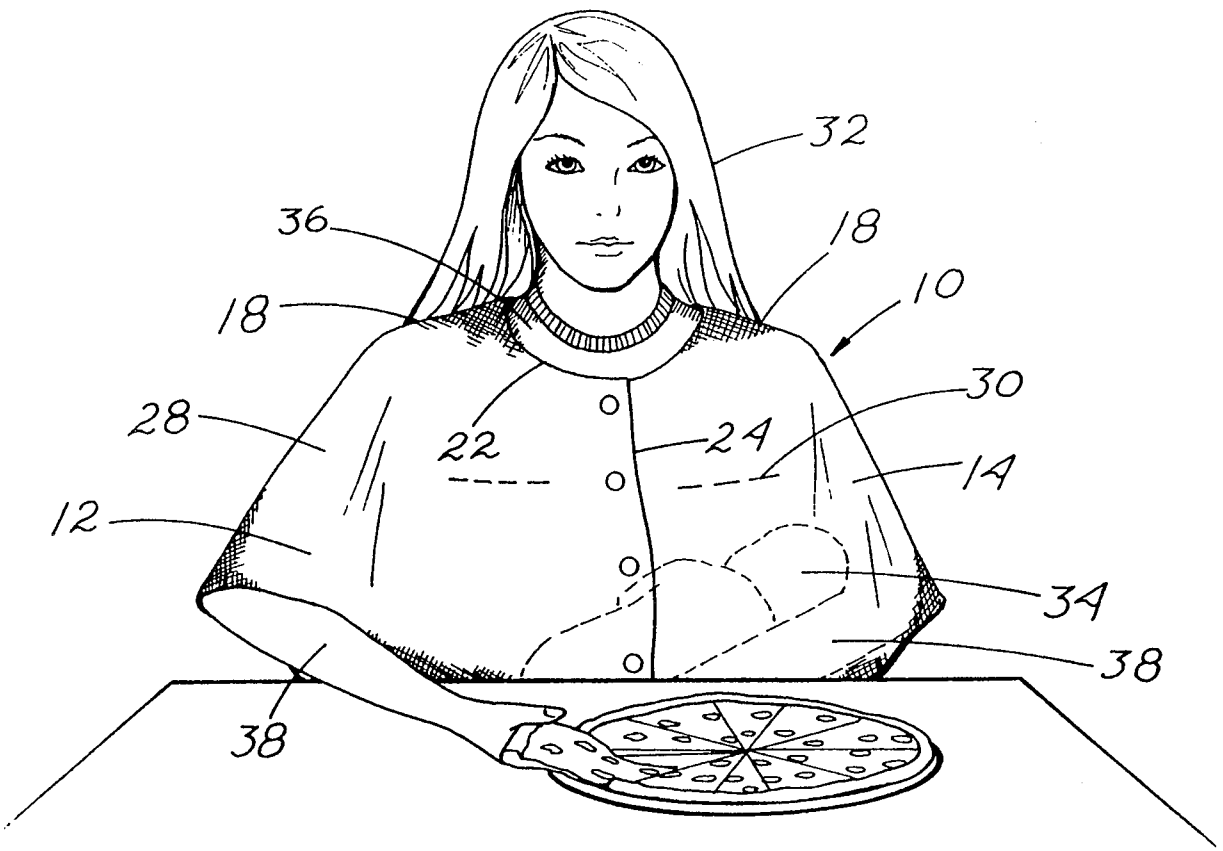
FIG. 4 illustrates the nursing cape according to the invention with shoulder sections covering the mother's arms down past her elbows. The drawing also illustrates the mother having at least one free arm to use her hand for eating or other purposes.

FIG. 4 shows nursing cape 10 according to the invention being worn by mother 32 nursing feeding infant 34 and is illustrative of shoulder sections 18 fully extended to cover mother's arms of mother 32 down past her elbows. Nursing cape 10 in the FIG. 4 drawing also illustrates how mother 32 has at least one of mother's arms 38 free to use her hand for eating or for other uses without exposing herself or feeding infant 34 to public scrutiny. Though the position of surveillance openings 30 are indicated by dotted lines in FIG. 4, this embodiment with extending shoulder sections 18 is provided with and without surveillance openings 30. It is to be noted that all embodiments of the present invention are intended for protection and privacy use over mother's 32 clothing. With this invention, mother 32 is afforded the privilege of wearing whatever clothing she wishes to wear while dining out or appearing in public as nursing cape 10 is convenient to carry and easy to slip into.

Therefore, the immediate invention, nursing cape 10, provides a simple light weight covering sufficiently sized to adequately provide a privacy shield for a breast feeding mother 32 and a covering for the feeding infant 34. Nursing cape 10 is especially useful in public areas where some people may take offense at a mother breast feeding her infant. Mother 32 has the use of at least one free arm 38 to use her hand for eating and for other uses even while nursing feeding infant 34. Surveillance openings 30 are provided so mother 32 can monitor feeding infant 34 without lifting the covering and to provide adequate ventilation for feeding infant 34. Nursing cape 10 is also very convenient in being fabricated from light weight materials, light fabric 28, and can be folded for easy storage and transporting in a purse or a diaper bag.

While preferred forms of the invention have been described in the specification and illustrated in the drawings, the presentation is not to be construed as limiting modifications to the invention so long as modifications made fall within the intended scope of the appended claims.

What we claim as our invention is:

1. An arms free nursing cape worn over both a mother and a breast feeding infant under said nursing cape to provide a privacy covering for the mother and infant in a public place, said nursing cape being a covering folded along a shoulder section and draped over the mother's shoulders with said covering continuing downwardly from said shoulder section, the downward continuation of said covering divided into two substantially equal halves, there being a neck opening generally centrally through said nursing cape for the mother's neck, said two substantially equal halves being a front half and a back half, said front half divided into two front panels separated by a frontal opening extending through said neck opening and downwards from said neck opening through a bottom edge of said front half, said frontal opening releasably fastened closed by a fastening means, said shoulder section extending on both sides of said neck opening sufficiently to provide covering over the mother's arms, said front half of said nursing cape being of sufficient length to provide covering for the breast feeding infant, said two front panels each having one short transverse surveillance opening positioned over the breasts of the mother providing an opening to allow the mother to view the infant breast feeding under said front panels, said surveillance openings each having fastening means thereon adapted to provide releasable closing of said surveillance opening, said surveillance openings being openable in a generally horizontal plane limiting viewing therethrough downwardly by the mother wearing said nursing cape, stiffening means affixed to said nursing cape around said surveillance openings adapted to maintain said surveillance openings sufficiently opened for viewing by the mother of the breast feeding infant, said nursing cape fabricated of a pliable light weight material being foldable for storage in a purse or in a diaper bag.

2. The arms free nursing cape of claim 1 wherein said fastening means for said frontal opening includes hook and loop fasteners.

3. The arms free nursing cape of claim 1 wherein said fastening means of said surveillance openings includes hook and loop fasteners.

4. The arms free nursing cape of claim 1 wherein said light weight material includes cotton and cotton blends.

* * * * *